US009750091B2

(12) United States Patent
Ahmad et al.

(10) Patent No.: US 9,750,091 B2
(45) Date of Patent: Aug. 29, 2017

(54) APPARATUS AND METHOD FOR HEAT TREATMENT OF COATINGS ON SUBSTRATES

(71) Applicants: APPLIED MATERIALS, INC., Santa Clara, CA (US); HELLER INDUSTRIES, INC., Florham Park, NJ (US)

(72) Inventors: Iftikhar Ahmad, Raleigh, NC (US); Clayton R. DeCamillis, Raleigh, NC (US); Robert J Schauer, Durham, NC (US); James E. Neville, Springfield, NJ (US)

(73) Assignees: APPLIED MATERIALS, INC., Santa Clara, CA (US); HELLER INDUSTRIES, INC., Florham Park, NJ (US)

( * ) Notice: Subject to any disclaimer, the term of this patent is extended or adjusted under 35 U.S.C. 154(b) by 235 days.

(21) Appl. No.: 13/573,947

(22) Filed: Oct. 15, 2012

(65) Prior Publication Data

US 2014/0103030 A1 Apr. 17, 2014

(51) Int. Cl.

| | |
|---|---|
| ***H05B 6/64*** | (2006.01) |
| ***H05B 6/50*** | (2006.01) |
| ***H05B 6/78*** | (2006.01) |
| ***H05B 6/80*** | (2006.01) |

(52) U.S. Cl.

CPC ..... *H05B 6/6482* (2013.01); *H05B 6/806* (2013.01); *H05B 2206/046* (2013.01)

(58) Field of Classification Search

CPC H05B 6/6482; H05B 6/806; H05B 2206/046; H01L 21/67017; H01L 21/67109; H01L 21/67248; H01L 21/67115; C23C 16/511; C23C 16/46; C23C 16/45565; C23C 16/481; H01J 37/3222; H01J 37/32192; H01J 2237/3321; H01J 65/044

USPC ..... 219/678, 679, 680, 684, 690, 693, 711, 219/700, 752, 753; 118/723 AN, 665, 118/712, 724, 725, 729, 730

See application file for complete search history.

(56) References Cited

U.S. PATENT DOCUMENTS

| | | | | |
|---|---|---|---|---|
| 3,854,024 | A * | 12/1974 | Kaufman et al. | 219/684 |
| 5,321,222 | A | 6/1994 | Bible et al. | |
| 5,521,360 | A | 5/1996 | Johnson et al. | |
| 5,648,038 | A | 7/1997 | Fathi et al. | |
| 5,721,286 | A | 2/1998 | Lauf et al. | |

(Continued)

*Primary Examiner* — Hung D Nguyen

(74) *Attorney, Agent, or Firm* — Moser Taboada; Alan Taboada

(57) ABSTRACT

An apparatus for thermal treatment of coatings on substrates includes a microwave applicator cavity; a microwave power supply to deliver power to the cavity; a thermally insulated microwave-transparent compartment within the cavity, large enough to contain the coated substrate while occupying no more than 50% of the total volume of the cavity; a means of supporting the coated substrate within the compartment; an adjustable IR heating source in the compartment and facing the substrate so that a selected amount of IR heating may be applied to the substrate; and, a non-contacting temperature measurement device to measure the temperature of the coating. Related methods for using the apparatus to process different kinds of films are also disclosed.

15 Claims, 4 Drawing Sheets

(56) References Cited

U.S. PATENT DOCUMENTS

| | | | | |
|---|---|---|---|---|
| 5,738,915 | A | 4/1998 | Fathi et al. | |
| 5,961,871 | A | 10/1999 | Bible et al. | |
| 6,399,411 | B1 * | 6/2002 | Hori | C23C 14/562 118/718 |
| 6,610,427 | B2 * | 8/2003 | Kashiwaya et al. | 428/701 |
| 6,657,206 | B2 * | 12/2003 | Keogh et al. | 250/492.1 |
| 2001/0054387 | A1 * | 12/2001 | Frankel | G07C 15/006 118/725 |
| 2005/0236395 | A1 * | 10/2005 | Timans et al. | 219/497 |
| 2008/0207008 | A1 * | 8/2008 | Peelamedu et al. | 219/756 |
| 2009/0238993 | A1 * | 9/2009 | Stowell et al. | 427/553 |
| 2012/0211486 | A1 * | 8/2012 | Kasai et al. | 219/679 |

* cited by examiner

Organic Light Emitting Diode (OLED)

Thin Film Solar Cells

Low cost organic thin-film transistor (TFT) with printable semiconductor material Liquid Crystal Display (LCD)

APPARATUS AND METHOD FOR HEAT TREATMENT OF COATINGS ON SUBSTRATES

BACKGROUND OF THE INVENTION

Field of the Invention

The invention pertains to apparatus and methods for heat treating coatings. The invention more particularly pertains to apparatus and methods for uniform heat treatment of these coatings on glass, ceramic, and/or flexible substrates using microwave energy.

Description of Related Art

There are several methods for depositing thin films on glass substrates and the number of available methods continues to expand with the growth of the flat panels market.

Some techniques require vacuum and thermal evaporation, whereby the material is heated and it evaporates to deposit a thin film on the substrates. These include vacuum evaporation deposition, Molecular Beam Epitaxy (MBE), different variants of Chemical Vapor Deposition (CVD) and Atomic Layer Epitaxy (ALE), studied extensively for semiconductor deposition and electroluminescent display applications, lately also referred to as Atomic Layer Deposition (ALD).

Another technique "Vapor Phase Deposition" (VPD) is proven to give better control on the structure and morphology of the film than vacuum thermal evaporation. It is usually applied to organic materials and hence also termed as Organic PVD or OPVD. The process involves evaporation of the organic material (hence lower temperatures) over a substrate in the presence of an inert carrier gas ($N_2$, argon, $H_2$ and forming gas). For more monomers, the monomer precursors can be co-deposited followed by a polymerization heat treatment.

Most films deposited on substrates need a heat treatment. Organic materials need to be cured well to provide optimum dielectric properties. Coatings for thin film transistors (TFT) in semiconductor electronics, flat panel displays (FPD) and thin film photovoltaic cells, all need the thermal treatment. Although some heat treatments could be carried out during the deposition process or in the same chamber, but usually the cures or anneals are time consuming and hence the thermal treatment is performed in a following separate step. Thus, the thermal treatment is conducted in curing ovens, on hot plates, in annealing furnaces, and of course with microwave energy as well.

Microwave energy because of its rapid and internal heating mechanism has been one of the very attractive means of heat treatment. For curing processes microwaves interact with the polar groups of molecules in the organic materials, enhance their mobility because of the rotational movement of molecules and hence enhance the cross-linking of monomers or cure of materials. In other semiconductor materials or coatings used for thin film transistors (in electronics, flat panel displays and photovoltaic applications), the microwave induced transport of current carriers and possible polarization, the anneal processes can be performed in shorter times or at somewhat lower temperatures. Although fixed frequency microwaves can be used for some applications, the heating across the large substrate surface may not be uniform. When the substrates have electrical traces and electronic circuits there is always the potential of charge build up on metal features which can lead to arcing and hence damage of the circuit.

In such situations Variable Frequency Microwaves (VFM) is well suited for uniformly processing electronic circuits and semiconductor materials. The basic VFM approach is well-known and taught in several U.S. Patents. The continuous sweeping of frequencies over the available bandwidth reduces the potential for arcing and subsequent damage. Frequency sweeping is carried out in a substantially continuous way over a selected bandwidth of frequencies. This provides much more uniform heating without the concerns of charge build up and arcing observed with single frequencies. Numerous kinds of wafers with integrated circuits have been exposed to VFM and it has been demonstrated that there is no damage to the circuits or their functionality.

However, for most of the coatings on the flat panels, the amount of material deposited as a thin film is a small fraction of the mass of the substrate, which is usually glass. In many cases microwaves will not heat the substrate significantly, so any heat generated in the coating material will be lost to the substrate acting as a huge heat sink. Thus the overall increase in temperature on the film will not be sufficient to perform the thermal treatment on the deposited film.

OBJECTS AND ADVANTAGES

Objects of the present invention include: providing a microwave heating system having a supplemental IR heater so that a coating and a substrate may be heated independently; providing a microwave heating system having a thermally insulated compartment to minimize heating of the entire volume of the cavity; providing a more controllable means of heating coatings on substrates by microwave power; providing an apparatus in which microwave heating and IR heating processes may be independently controlled; providing a method for heat treating coated substrates in which heating of the substrate and coating may be done to some degree independently of one another, providing a more efficient and controllable method for heat treating coated substrates, and providing an improved microwave treatment process for thin coatings on glass substrates. These and other objects and advantages of the invention will become apparent from consideration of the following specification, read in conjunction with the drawings.

SUMMARY OF THE INVENTION

According to one aspect of the invention, an apparatus for thermal treatment of coatings on substrates comprises:

a microwave applicator cavity;

a microwave power supply to deliver power to the applicator cavity;

a thermally insulated microwave-transparent compartment within the cavity, the compartment being large enough to contain the coated substrate while occupying no more than 50% of the total volume of the applicator cavity;

a means of supporting the coated substrate within the compartment;

an adjustable IR heating source contained within the compartment and facing the substrate so that a selected amount of IR heating may be applied to the substrate; and, a non-contacting temperature measurement device to measure the temperature of the coating on the substrate.

According to another aspect of the invention, a method for microwave treatment of coatings on substrates comprises the steps of:

a) forming a thermally insulated, microwave transparent compartment within a microwave applicator cavity, the compartment occupying no more than about 50% of the overall volume of the cavity, the compartment further comprising an adjustable IR heat source;

b) supporting the coated substrate within the compartment at a selected distance from the IR heat source;

c) providing power to the IR heater to heat the substrate to a first selected temperature; and, d) introducing microwave power into the cavity to heat treat the coating to a second selected temperature for a selected time.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore non-limiting embodiments illustrated in the drawing figures, wherein like numerals (if they occur in more than one view) designate the same elements. The features in the drawings are not necessarily drawn to scale.

DETAILED DESCRIPTION OF THE INVENTION

Figure 1:
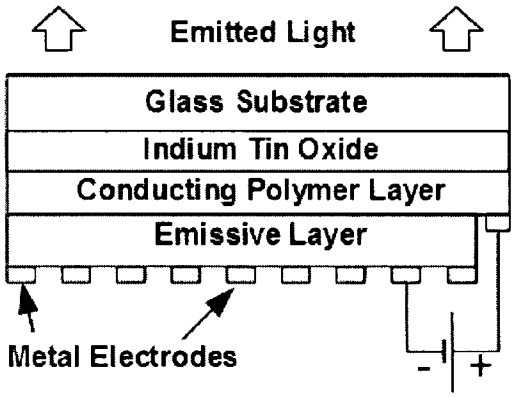
FIG. 1 illustrates various devices, each having multiple layers of coatings. Many of these layers have to be heat treated (baked or annealed) to allow the device to function properly.
Figure 1:
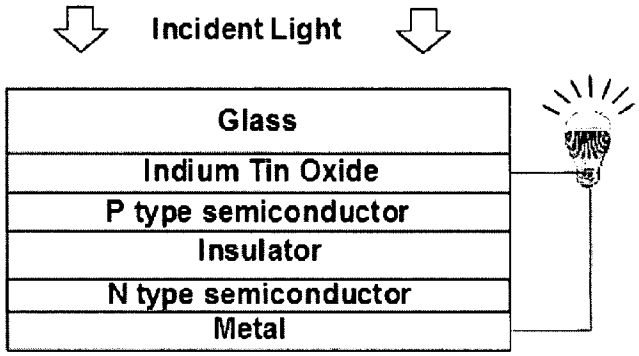
Figure 1:
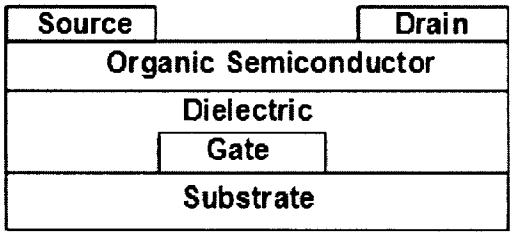
Figure 1:
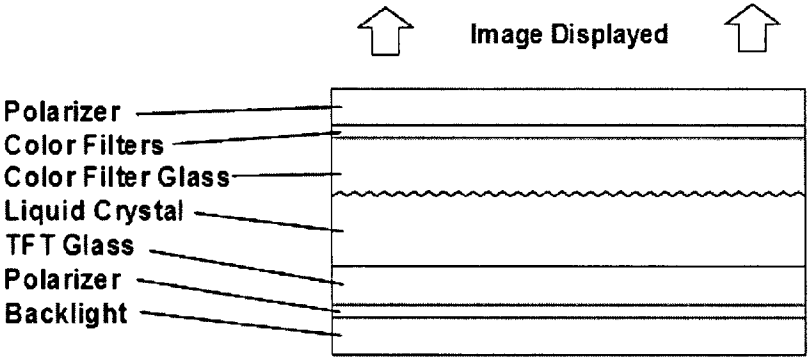

The invention is intended to provide a method to heat a substrate while rapidly processing films that have been deposited on the substrate, particularly for applications such as flat panel displays, flexible displays, or thin film solar cells, as well as coatings on other solar panels. Applicants have found that a key advantage of the process is to incorporate the rapid curing features of microwave heating (in polymeric films where monomers have not cross-linked, microwaves interact with these polar groups or molecules and enhance the cure process) along with the use of IR to selectively raise the substrate temperature, for better efficiency when the substrate is relatively transparent to microwave power. Microwaves have demonstrated shorter time and lower temperature cures for many polymer systems. The same experience applies to semiconducting thin film transistors (TFT), which have been annealed or heat treated at lower temperature and shorter times while still achieving the same properties. Thus microwaves provide the enhanced reaction kinetics in the deposited film while IR provided some bulk heating to the substrates which are mostly transparent to microwave power.

Variable Frequency Microwave (VFM) has been demonstrated to be very suitable for processing semiconductor materials and thin film coatings used for numerous electronics, and this invention pertains to applying it to flat panel displays and photovoltaic applications. The basic VFM approach is well known and taught in at least the following U.S. Patents, each of which is incorporated herein by reference in its entirety: U.S. Pat. Nos. 5,321,222; 5,721,286; 5,961,871; 5,521,360; 5,648,038; and 5,738,915. In particular, the continuous sweeping of frequencies over the available bandwidth, as taught in the aforementioned references, reduces the potential for arcing and subsequent damage when metallic or semiconducting components are part of the workpiece to be processed. Frequency sweeping is often carried out by selecting a center frequency and then rapidly sweeping the frequency in a substantially continuous way over some range (typically +/−5% of the center frequency, although this range can vary depending on such factors as the type of microwave source, and the overall size of the cavity compared to the microwave wavelength). Numerous kinds of wafers with integrated circuits have been exposed to VFM and it has been demonstrated that there is no damage to the circuits or their functionality. The use of VFM provides more rapid processing as compared to conventional heat treating furnaces.

One of the objectives in processing is to provide uniform and rapid microwave heat treatment of thin film coatings on large substrates, especially those with metallization that cannot be easily processed with single frequency microwaves because of the potential for charge buildup, leading to arcing and hence damaging the electronic devices or circuits. On substrates, especially those with simple organic coatings and little or no metallic traces, single frequency microwaves may apply equally well and are thus not excluded from this invention. In the same way, it will be understood that although some of the exemplary descriptions herein refer to multimode cavities, the invention may also be used in a single mode cavity for particular applications. Therefore, the invention applies to microwave heating in general, with Variable Frequency Microwave (VFM) heating in a multimode cavity being preferred in many cases.

Schematic illustrations of various coatings used in Thin Film Transistors (TFT) and their use in Liquid Crystal Displays, Organic Light Emitting Diode (OLED) displays and the structure of thin film solar cells are shown in FIG. 1. The common processes for the fabrication of these numerous devices (not limited to only the examples used here) are briefly described.

Deposition: Some of the deposition methods were mentioned in the Background material above. Polymer semiconductors can be used in the fabrication of devices in FIG. 1. The films can be deposited from soluble precursors and are subsequently converted (thermal process) to the final form of the film. Dielectric films are also fabricated in a similar manner followed by an anneal process.

Patterning: One of the well developed techniques for patterning microelectronics circuits and photonics devices is optical lithography, where shapes from a mask are transferred to a substrate to produce a desired pattern in the active materials and electrodes. Both metal and conducting polymer electrodes can be fabricated using standard a photolithographic approach. However, this is a relatively expensive process and is less suitable for patterning organic semiconductors because of the exposure to solvents and etchants, which may cause degradation in device performance. Other low cost and simpler approaches such as screen printing and ink-jet printing are being adopted and perfected for flat panel display and solar cell manufacturing.

The feature size resolution with these techniques is around 25 μm whereas optical lithography can achieve resolution as fine as 100 nm.

Pre-bake, bake or anneal: At various steps during the processes there may be the need to either pre-bake the substrate, bake or cure some polymeric coating or anneal the dielectric or semiconductor material. All of these thermal processes can be performed by microwaves (preferably with variable frequency microwaves) and is the primary object of this invention.

Currently, the pre-bake, cure, or anneal process is carried out in convection ovens or on hot plates. Some higher temperature anneal can also be carried out in radiant ovens. No matter what the heating method, the source of heat is mostly external. With microwaves the heating mechanism occurs within the material and the molecular interaction with microwave usually enhances the reaction kinetics.

This is achieved for thin films on substrate, both rigid and flexible, as explained in the following examples.

Example 1

FIG. 1 shows the schematic for a few of the many devices, each having several layers or coatings, which include but are not limited to semiconducting films, dielectric film, conducting layers (including transparent ITO), emissive layers, color filters, liquid crystal and polarizer layers.

With the time required to complete processing of each layer, it is natural to consider microwave heating, which can reduce the processing time as well as (where appropriate) reduce the temperature.

Example

Figure 2:
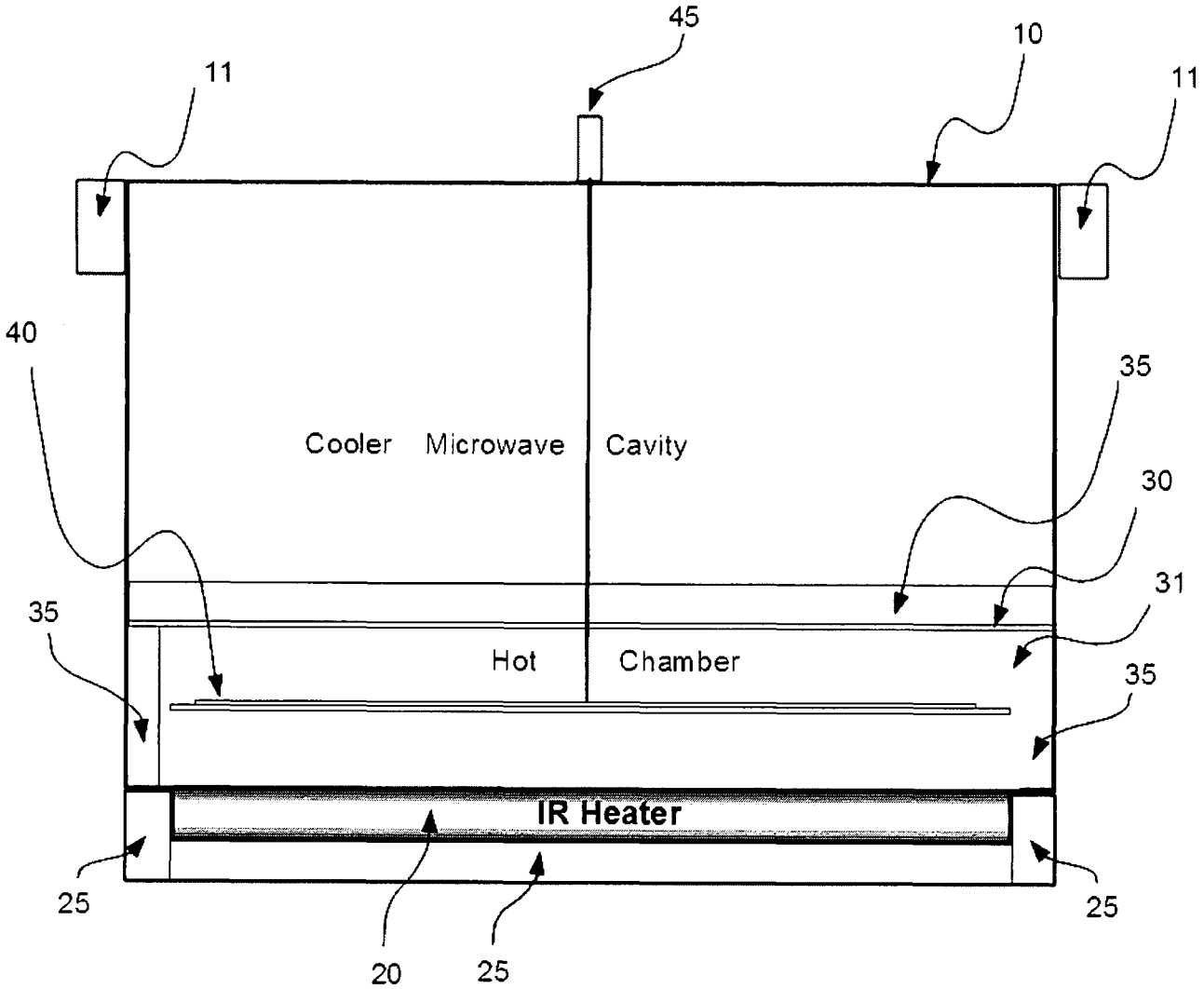
FIG. 2 illustrates the schematic drawing of the apparatus used for heat treating coatings on substrates. It shows the microwave cavity and IR heater on the base of the cavity, where IR heats the (glass) substrate while microwaves enhance the processing of the thin films coated on the substrate.

One example of the inventive apparatus is illustrated schematically in FIG. 2, which shows a cavity 10 into which microwaves are delivered from sources 11. These could be single frequency microwaves or preferably variable frequency microwaves (VFM). At the bottom of the cavity is a compartment containing the workpiece 40 and an IR heater 20. The purpose of IR heater 20 is to heat the substrate, which usually does not heat well with microwaves. (Glass substrates in particular tend to be relatively transparent to microwaves and therefore exhibit very low dielectric loss.) The IR heater may be one or more IR lamps, IR heaters of various shapes, gas heated platens or the like. The IR heater 20 is preferably controlled independently from the microwave power source 11. Surrounding the IR heater is thermal insulation 25 used to retain the heat.

To keep the environment clean for processing flat panels, the compartment preferably contains a ceramic (such as quartz) enclosure all around, shown as 30 on the top and 31 on the side. The side quartz panels 31 provide one means to adjust the height of the workpiece 40 from the IR heater for an optimum process. The substrate may alternatively be supported on a number of dielectric pins around its periphery (not shown), and these pins may be connected to mechanical feed-throughs that allow the substrate to be raised and lowered according to a selected process recipe or as part of a feedback control system, as generally taught by Wander et al. in U.S. patent application Ser. No. 13/065,606, the entire disclosure of which is incorporated herein by reference. However, the independent temperature control of the IR heater can also be used for this purpose. The insulation 35 around this quartz enclosure is preferably tailored for microwave processing and like quartz may be almost completely transparent to microwaves. (Note that the insulation 25 around the bottom and sides of the IR source could be any insulation since it is out of the microwave chamber.) This allows microwave power to pass through and efficiently cure, bake, or anneal the coatings on the substrate. The insulation 35 helps to contain the heat generated from microwaves and IR within the compartment surrounding the workpiece. The compartment is significantly smaller than the overall volume of the cavity 10, as shown in FIG. 2; Applicants prefer that the compartment occupies no more than about 50% of the overall volume of cavity 10. Those skilled in the art will appreciate that by keeping the heated volume small compared to the effective (electrical) volume of the applicator cavity, the rest of the cavity will remain relatively cooler for optimum microwave reflection from the wall of the cavity. If the temperature on the cavity walls will increase, it will decrease the electrical conductivity and hence the reflection of microwaves thereby making the microwave chamber less efficient. Furthermore, by keeping the bulk of the cavity cooler, overall thermal efficiency improves and less cooling is needed in the factory environment.

Example

For processing a coating on a panel at 270° C. the IR heater having an independent control was turned on until the ambient temperature or panel temperature reached 170° C. at which point VFM power was turned on. Within 5-10 minutes the workpiece reached 270° C. (It will be appreciated that the time will vary somewhat depending on the mass of the panel). The soak temperature was maintained for 5 minutes (this can be varied depending on the particular process) after which both the VFM power and IR were turned off. During this entire process, the temperature of the cavity wall (and presumably the air volume above insulation) was only ~40° C.

The temperatures given above are for one specific process, but those skilled in the art recognize that various coatings on different substrates may require different process temperature and times. The important point is that the temperature of the substrate achieved with IR is preferably 50-100° C. lower than the intended VFM process temperature, so as to have VFM heating of the coating and the reaction enhancements associated with microwave treatment; with too much IR heating it will become primarily a thermal process rather than a microwave-enhanced process.

Example

This example is for processing a 6 mm thick ceramic substrate (for low temperature co-fired ceramics LTCC) having a Hitachi DuPont # HD 4110 polyimide (PI) coating to be cured. The VFM cure temperature for this specific PI material is 340° C. (whereas it is conventionally cured in convection at 380° C. for 1 hour). In an earlier setup run the ramp time (>45 minutes) to 270° C. with IR setting was identified. In the subsequent real process run, both IR and VFM were turned on simultaneously and gradually increased to the predetermined settings. After 45 minutes of ramp the soak temperature of 340° C. was achieved and maintained for 15 minutes after which the temperature was gradually reduced to 280° C. and then both VFM and IR turned off. In this and other longer runs, the cavity wall temperature can reach ~50° C.

Those skilled in the art will appreciate that the compartment of the present invention differs significantly from insulating boxes traditionally used in high temperature microwave processes such as sintering ceramics and the like. Conventional insulating boxes, often called "caskets", sometimes contain lossy materials such as rods or granules of material such as SiC that are intended to absorb microwave energy and provide supplemental or "hybrid" heating, particularly when the workpiece will only begin to absorb microwave energy after it has been heated to a fairly high temperature. One key difference is that the lossy materials in a conventional casket cannot be heated independently of applied microwave power, on the contrary, their heat output is directly related to the applied microwave power until the workpiece begins absorbing the microwaves, at which point their heat output becomes a more complicated function of microwave power, relative masses of workpiece and lossy material, and their relative dielectric losses. Another key difference is that the lossy materials in a conventional casket may be arranged in various ways around the periphery of the workpiece (the so-called "picket fence" approach) or they may be dispersed as a substantially granular material among multiple workpieces when the load being processed is a batch of small articles. In the present invention, the IR source is independently controllable and configured to apply IR or radiant heating to the underside of the substrate while microwave power is applied to the coated side.

Another important advantage is that conventional casketing approaches involve significant set-up and disassembly time and they typically involve granular or friable insulation materials that are detrimental to the cleanliness requirements of typical thin film processing.

Example

Above the IR heater and within the quartz enclosure 30, 31 is the substrate 40 with a deposited coating to be heat treated on its upper surface. The temperature of the coating is monitored and controlled via the non-contacting temperature measurement device 45 through a hole/window in the insulation 35. Device 45 may be any suitable non-contacting or IR-based thermal measurement system, and may include a one-color or two-color pyrometer operating at any suitable IR wavelength or band. Furthermore, device 45 may comprise two separate pyrometers, having different sensitivities to surface emissivity as taught by Applicants in U.S. Pat. No. 8,021,898, the entire disclosure of which is incorporated herein by reference. The two pyrometers may comprise two one-color devices operating at different IR wavelengths, or they may comprise a one-color and a two-color pyrometer. In either case, changes in surface emissivity may be detected and used in a process control strategy if desired.

The system described in the foregoing example is generally suitable for processing thin film coatings on generally rigid glass substrates. However, the invention can also be adapted to process coatings on thin and relatively flexible substrates such as very thin glass and polymers. For such applications the invention may be implemented in a roll-to-roll (also called reel-to-reel) configuration.

Example

Figure 3:
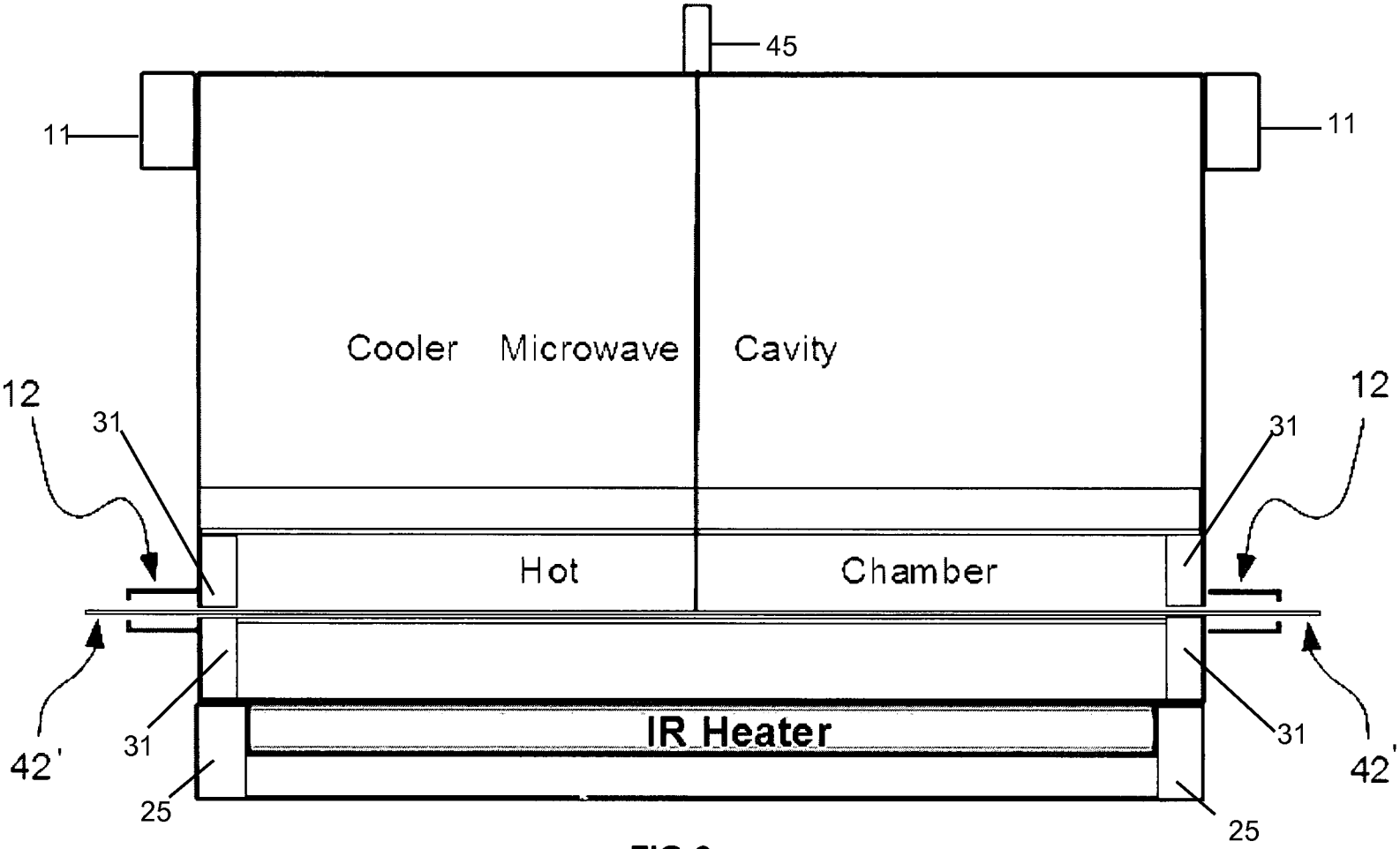
FIG. 3 illustrates the schematic details of the apparatus for flexible substrates. The flexible substrates have coatings that need to be heat treated to allow the device to function.

FIG. 3 shows a variant of the apparatus shown in FIG. 2, wherein the processing cavity has slots to allow a continuous or semicontinuous workpiece, such as substrate 42', to pass through the processing compartment. The slots are preferably fitted with microwave chokes 12, which will reduce microwave leakage to acceptable levels while allowing a continuous web or flexible substrate to pass through. The optimum distance between IR heater 20 and substrate 42', as well as the residence time of the flexible substrate within the microwave chamber may be adjusted through routine experimentation to optimize the heat treatment process. Depending on the upstream and downstream process, the movement of the flexible substrate could be continuous or indexed.

Example

Figure 4:
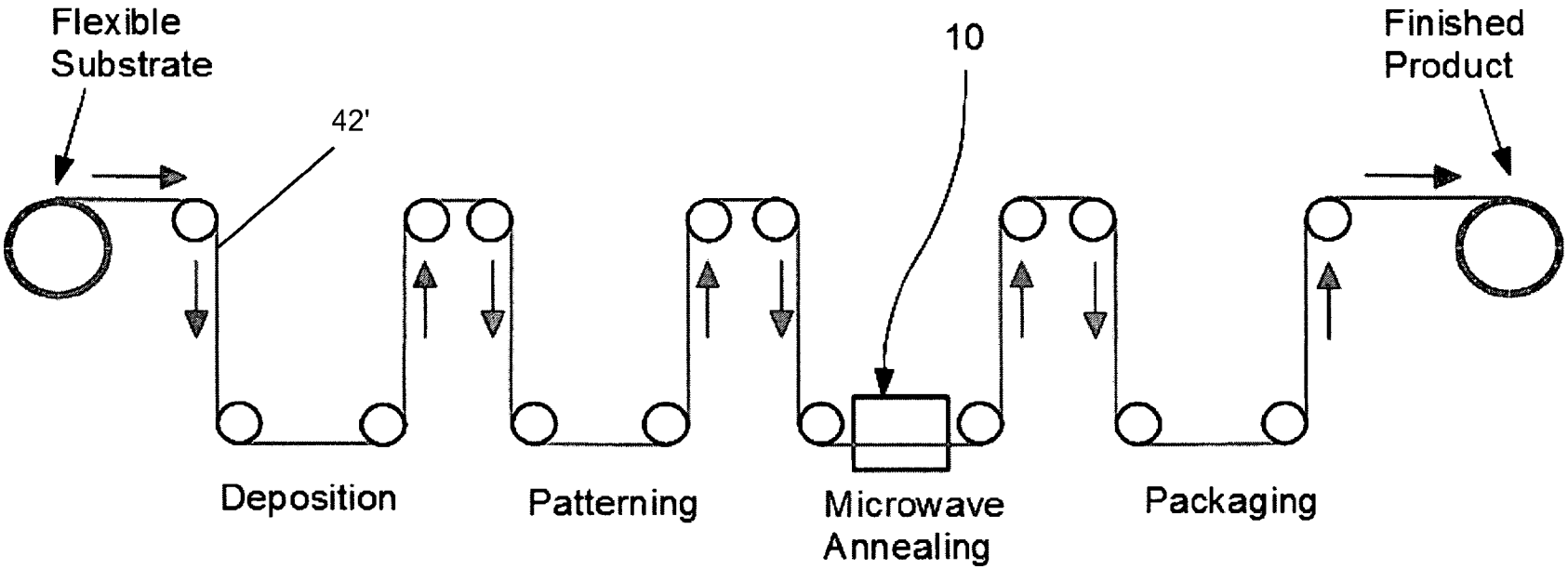
FIG. 4 illustrates the schematic concept of roll to roll process where thin films are first deposited followed by patterning of coated material and then curing, annealing or heat treatment (shown with microwaves) and then final packaging.

The incorporation of the invention into a roll to roll process is shown schematically in FIG. 4, in which a microwave anneal apparatus 10 forms one module of a manufacturing line that may contain various other upstream and downstream process modules. For processing multiple layers one could employ multiple passes through the roll to roll line to complete the fabrication of flexible displays, for example. Note that in the case of a continuous process, there will generally not be a separate means of supporting the workpiece within the processing chamber, but rather the workpiece will simply be held in tension by the supporting rollers located outside the chamber as shown schematically in FIG. 4.

The following examples describe various applications for which the invention may be used.

Example

Heat Treatment of TFT and Color Filters on Glass Substrates: VFM can be used for annealing or thermal treatment of coatings deposited on glass substrates. In LCD manufacturing, the R, G, B color filter coatings are used and need to be annealed. The VFM/IR process as shown in FIG. 2 could be used to shorten the process time as compared to convection ovens, while yielding equivalent properties. Furthermore, the Thin Film Transistors (TFT) on such display panels need to be annealed. Using the inventive method, it would be possible to anneal these TFT at lower temperatures and shorter times, while achieving the same electrical characteristics.

Example

Heat Treatment of Transparent Conductive Oxide on Glass Substrates:

Indium Tin Oxide (ITO) films also called Transparent Conductive Oxide (TCO) are becoming very popular for numerous applications, although there are others (AZO and IZO) also being considered. These films are used for liquid crystal displays, optoelectronic materials and solar cells. The crystalline structure, grain size, optical transmittance and conductivity all are influenced by the anneal temperatures, therefore, choosing an appropriate annealing process is important for making high quality ITO films. VFM may be used for annealing, densification and influencing the grain structure of such films.

Example

Cure of Polyimide Films:

Polyimide (PI) films of numerous kinds and from various vendors have been spin coated on silicon wafer and soft baked for the ease of transportation. These films are usually cured in convection or diffusion ovens at sufficient temperatures (350-400° C.) to assure adequate mechanical and electrical properties.

There is great emphasis in the semiconductor industry to cure these dielectric films preferably at lower temperature and Variable Frequency Microwaves (VFM) has been successfully demonstrated to cure of polyimide at temperature 50-150° C. lower than the standard convection cure temperatures while maintaining the necessary final mechanical and chemical film properties. The following polyimide materials from HD Microsystems: PI-2525, PI-2611, PIX-3400, PIX-8103, SPL-6000, SPL-1708, and HD-8800, have been cured with VFM with substantial reduction in thermal budget (saving in time and/or temperature) depending on the availability of the polar groups.

For display applications PI has been coated on glass substrates and cured. However, unlike wafers that heat well with microwave, glass panels do not heat readily. Using the arrangement depicted in FIG. 2, where the glass substrate is independently heated by IR means, it was possible to cure PI films on glass substrates.

Example

Co-Deposition of Monomers and Subsequent Imidization:

The above example used spin coater equipment for depositing the film. However, there are disadvantages to the spin coating approach which include contamination of the films by residual solvents, film shrinkage, poor control of molecular orientation and environmental handling issues with solvent disposal. An alternative to this method is co-deposition of the monomer precursors onto a solid substrate. With Vapor Phase Deposition (VPD) or Vapor-Deposition Polymerization (VDP), when monomer precursors for polyimide are co-deposited and subsequently imidized, the process may produce polyimide films with material properties and uniformity that are superior to the spin-coated films.

Like many other polyimide cure processes, there can be a relatively lower temperature soft bake during the deposition followed by high temperature final cure. This final cure temperature is usually in the 350-400° C. range. However, VFM cures on already soft baked film have been performed in the 200-250° C. range with properties comparable to those performed at high temperature with conventional method. The same co-deposition of monomers can be performed on glass substrate as shown in FIG. 1 for dielectric film on glass substrate and cured in the arrangement shown in FIG. 2. If however, flexible substrates are used it is possible to cure it in arrangement shown in FIG. 3.

Example

Vapor Phase Deposition of High k Dielectrics:

Vapor phase deposition is being explored for producing gate dielectrics suitable for next generation CMOS devices. The technique has been used for obtaining high-k dielectrics films of $La_2O_3$, $Al_2O_3$, $ZrO_2$, $HfO_2$, $Y_2O_3$, $Nb_2O_5$, $LaAlO_3$, $LaScO_3$, $ZrSiO_4$, $HfSiO_4$, $SrTiO_3$ and $SrTa_2O_6$. After any of these films have been (co)deposited on a wafer there is a low temperature step in $O_2$ to drive out the solvents followed by a higher temperature step in $N_2$ to achieve the appropriate dielectric properties.

VFM anneal in $N_2$ has been performed on these materials at 300-350° C. and achieved comparable properties to those obtained at 450° C. in convection ovens.

For similar devices as Thin Film Transistors (TFT) on glass substrates instead of silicon wafer, the arrangement shown in FIG. 2 can be used to anneal these high-k films, where the glass substrate is heated by IR or some other non-microwave means.

Example

Organic Light Emitting Diodes (OLED):

Organic Vapor Phase Deposition (OVPD) is being extensively explored for the fabrication of Organic Light Emitting Diodes (OLED). The advantages include higher materials utilization, increased control over the deposition process, higher potential throughput, higher yield and lower manufacturing costs. OVPD technology also provides a significant step toward fabrication of organic electronics, including OLED being efficiently deposited on thin flexible surfaces. The step of annealing or heat treating these coatings on glass or flexible substrates could be carried out in the arrangement depicted in FIG. 2 and FIG. 3. With flexible and organic materials the need for lower temperature processes becomes more important and the previous examples have shown that microwave processing has the potential to reduce thermal budgets significantly.

Example

Thin Films for Photovoltaics:

The same approach described above applies for films investigated for photovoltaic or organic thin film solar cells fabricated on various substrates. As the precursors become available for organic coatings used on solar cells, they could be vapor deposited on glass or flexible substrates and be heat treated with microwaves by the apparatus in FIG. 2 and FIG. 3.

It will be appreciated that although some of the foregoing examples and discussions were presented particularly with VFM systems using TWT amplifiers as the microwave source, the invention may be used in all systems that may employ microwave generators using single or multiple magnetrons, klystrons, gyrotrons, TWT amplifiers, or other microwave power generating devices as are well known in the art. It will be understood that the invention may be carried out in any suitable microwave cavity, which may employ various conventional means for improving power uniformity, including frequency sweeping, frequency hopping, mechanical mode stirring, and the use of multiple launchers. The cavity may be single-mode or multimode, and may be of any suitable shape.

We claim:

1. An apparatus for thermal treatment of coatings on substrates for electronics applications, comprising:

a microwave applicator cavity;

a microwave power supply to deliver power to said microwave applicator cavity;

a thermally insulated microwave-transparent compartment within said microwave applicator cavity, said compartment being large enough to contain said coated substrate while occupying no more than 50% of the total volume of said microwave applicator cavity, wherein said microwave applicator cavity further comprises slots on opposite sides to allow said coated substrate to pass through said microwave applicator cavity;

a means of supporting said coated substrate within said compartment;

an adjustable IR heating source contained within said compartment and facing said coated substrate so that a selected amount of IR heating may be applied to said coated substrate; wherein the adjustable IR heating source operates independently of said microwave power supply and further comprises a means of adjusting the distance between said coated substrate and said IR heating source according to at least one of a process recipe or a feedback system; and, a non-contacting temperature measurement device to measure the temperature of said coating on said coated substrate.

2. The apparatus of claim 1 wherein said microwave cavity is selected from the group consisting of: multimode cavities and single mode cavities.

3. The apparatus of claim 1 wherein said microwave power supply comprises at least one device selected from the following group: magnetrons, klystrons, gyrotrons, and TWT amplifiers.

4. The apparatus of claim 1 wherein said means of supporting said coated substrate comprises a ceramic supporting structure located within said compartment.

5. The apparatus of claim 1 wherein said non-contacting temperature measurement device comprises at least one device selected from the group consisting of: one-color pyrometers and two-color pyrometers.

6. The apparatus of claim 5 wherein said non-contacting temperature measurement device comprises two pyrometers having different sensitivities to surface emissivity, so that emissivity changes may be detected and used as a process control parameter.

7. The apparatus of claim 1 wherein said coated substrate comprises a continuous film.

8. The apparatus of claim 1 further comprising microwave chokes to reduce the leakage of microwaves from said slots.

9. A method for microwave treatment of a coating on a flexible substrate for use in electronics applications, comprising:

a) disposing a flexible substrate having a coating disposed thereon in a thermally insulated, microwave transparent compartment within a microwave applicator cavity, said compartment occupying no more than about 50% of the overall volume of said cavity, said compartment further comprising an adjustable IR heat source;

b) supporting said coating on said flexible substrate within said compartment at a selected distance from said IR heat source;

c) providing power to said IR heat source to heat said flexible substrate to a first selected temperature, wherein said distance between said substrate and said IR heat source is adjustable; and d) introducing microwave power into said cavity to heat treat said coating on said flexible substrate to a second selected temperature for a selected time, wherein said second selected temperature is higher than said first selected temperature, wherein said flexible substrate comprises a continuous film and said microwave applicator cavity further comprises slots on opposite sides of said cavity to allow said film to pass through said cavity for processing and wherein said power to said IR heat source and said microwave power are independently adjustable.

10. The method of claim 9 wherein said microwave applicator cavity is a multimode cavity.

11. The method of claim 9 wherein said microwave applicator cavity is a single mode cavity and said microwave power is characterized by a single frequency.

12. The method of claim 9 further comprising the step of:

e) measuring the temperature of said coating on said substrate using a non-contacting temperature measurement system.

13. The method of claim 12 wherein said temperature measurement system comprises two pyrometers having different sensitivities to surface emissivity, so that emissivity changes may be detected and used as a process control parameter.

14. The method of claim 9, wherein said coating on said substrate comprises one or more semiconductor materials or thin film coatings used for electronics applications.

15. An apparatus for thermal treatment of coatings on substrates, comprising:

a microwave applicator cavity;

a microwave power supply to deliver power to the microwave applicator cavity;

a thermally insulated microwave-transparent compartment within the microwave applicator cavity, the compartment being large enough to contain a coated substrate while occupying no more than 50% of the total volume of the microwave applicator cavity;

a means of supporting the coated substrate within the compartment;

an adjustable IR heating source contained within the compartment and facing the coated substrate so that a selected amount of IR heating may be applied to the coated substrate, wherein the adjustable IR heating source is independently controllable from the microwave power supply, and wherein the distance between the coated substrate and the adjustable IR heating source is adjustable;

thermal insulation disposed around the adjustable IR heating source to retain heat generated by the adjustable IR heating source; and a non-contacting temperature measurement device to measure the temperature of the coating on the coated substrate.

* * * * *